US006141809A

United States Patent [19]

Lyngholm

[11] Patent Number: 6,141,809

[45] Date of Patent: Nov. 7, 2000

[54] WING PROFILE SAIL

[76] Inventor: Tore Lyngholm, Skåregaten 171, N-5500 Haugesund, Norway

[21] Appl. No.: 09/319,996

[22] PCT Filed: Dec. 15, 1997

[86] PCT No.: PCT/NO97/00337

§ 371 Date: Aug. 11, 1999

§ 102(e) Date: Aug. 11, 1999

[87] PCT Pub. No.: WO98/26982

PCT Pub. Date: Jun. 25, 1998

[30] Foreign Application Priority Data

Dec. 16, 1996 [NO] Norway ..... 965414

[51] Int. Cl.[7] ..... B63B 35/79; B63H 9/04

[52] U.S. Cl. ..... 14/102.22; 114/102.29; 114/39.31

[58] Field of Search ..... 114/39.29, 39.31, 114/102.22, 102.23, 103, 102.29

[56] References Cited

U.S. PATENT DOCUMENTS

| | | | |
|---|---|---|---|
| 3,132,620 | 5/1964 | Court | 114/39 |
| 4,741,282 | 5/1988 | Duke | 114/103 |
| 4,753,186 | 6/1988 | Paras | 114/103 |
| 5,671,690 | 9/1997 | Trost | 114/103 |
| 5,931,109 | 8/1999 | Hill | 114/102.22 |

FOREIGN PATENT DOCUMENTS

| | | |
|---|---|---|
| 924572 | 11/1992 | Norway . |
| 1153056 | 5/1969 | United Kingdom . |
| 2295998 | 7/1996 | United Kingdom . |
| 9426587 | 11/1994 | WIPO . |

*Primary Examiner*—S. Joseph Morano
*Assistant Examiner*—Patrick Craig Muldoon
*Attorney, Agent, or Firm*—Browdy and Neimark

[57] ABSTRACT

A wing profile sail is in the form of a sailcloth which defines an airfoil-shaped space, which is filled with air through openings or one-way closing mechanisms. At the sail's luff (1) there is provided a bag/lung-shaped body which can be filled with air and which is extendable in the height direction and which in an extended state forms an upwardly tapering conical, cylindrical body (11). The sail's outer cloth (2, 3) extends from this body (11) and is transferred on each side from this body (11) and is attached at a distance from the after leech (7), the sail's after part (7) being composed of one sailcloth surface. From the outer sailcloth's (2, 3) attachment area, in the inner spaces of the sail there is provided an intermediate sailcloth, which at least covers the area of the openings for air supply. The outer sailcloths (2, 3) are connected in the sail's bottom area in order to form the inner spaces in such a manner that the outer sailcloths are movable in relation to each other.

20 Claims, 11 Drawing Sheets

FIG. 2A(1)
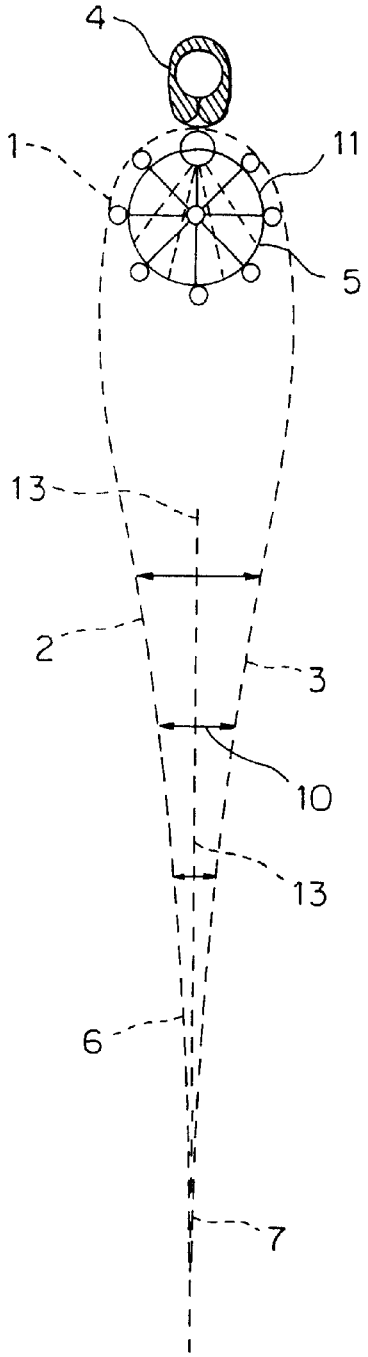
FIG. 2A(2)
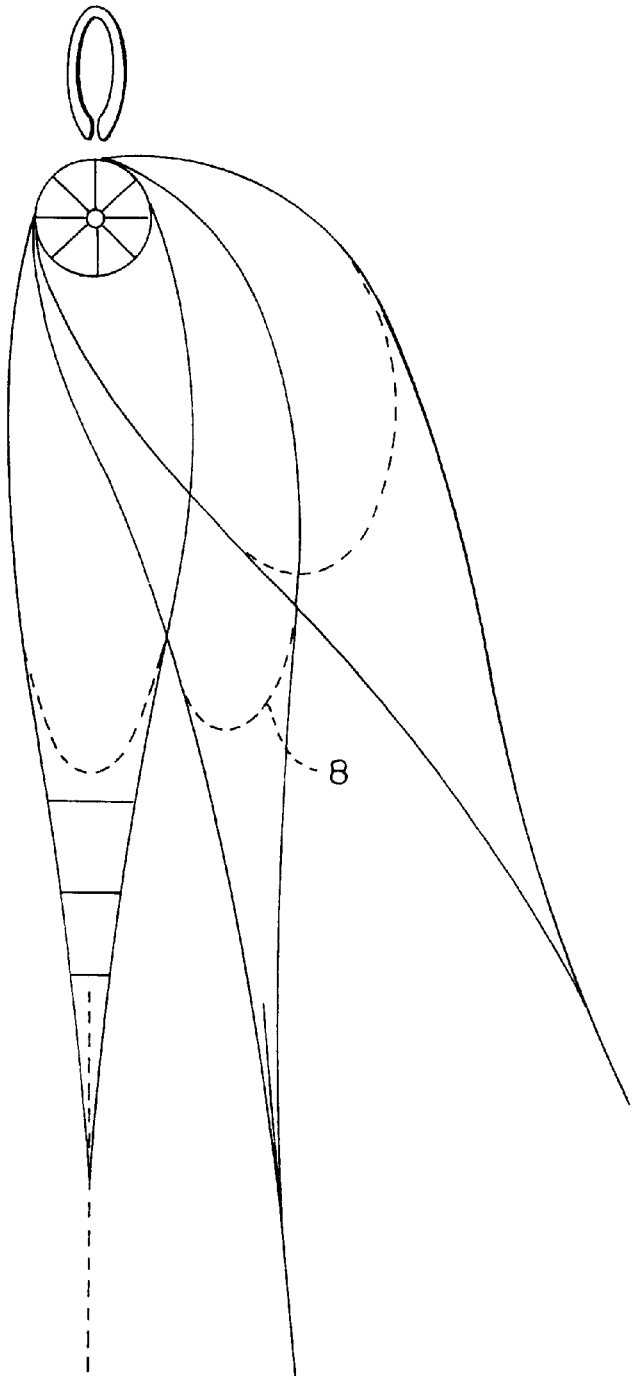

WING PROFILE SAIL

BACKGROUND OF THE INVENTION

Technical Field of the Invention

The invention concerns a wing profile sail wherein a sailcloth defines an airfoil-shaped space which can be filled with air through openings equipped within one-way closing mechanisms.

Over the years a number of different types of wing profile sails have been developed in the field of sails for sailing boats, where attempts have been made to give the sail surfaces the most aerodynamically favourable shape in order to achieve maximum utilisation of the wind forces. A variety of models have been developed from profiled masts in which the actual sail forms an extension of the mast profile, to sails where the sailcloth defines spaces, which may have the aerodynamic shape of airfoils. Examples of these can be found, e.g., in British patent publication 2196310 and U.S. Pat. Ser. No. 4,753,186. In the British publication stays are used for forming the sail's outer surfaces in the most favourable way possible and for changing the sail's profile according to wind direction, while in the U.S. publication an inflatable lung or bag is place inside the sail for adapting its profile to wind influence.

The effect which is achieved with such "three-dimensional" sails is that the wind which strikes the wing profile sail on the windward side on the bow will have a longer flow path on the sail's convex side than on the sail's flat or slightly concave opposite side, thus generating a force component over the sail's convex side. The different air flow paths on the two sides of the sail will enable a vessel equipped with a wing profile sail of this kind to sail close to the wind to a far greater extent than a similar vessel with conventional sails.

In the applicant's previous Norwegian patent application 924572 a wing profile sail is described with two side sailcloths and an intermediate pocket or lung, which is filled with air via valve openings. In this design the sail's two side sailcloths are connected in front of and at the rear of the sail, with the result that the sail's inner space extends right out to the after leech. The sail is further shaped by the point in the front edge. Thus, in the same way as a traditional sail, the sail will have a narrow groove with great efficiency when the vessel is sailing closehauled for the greater deviation of angles of attack obtained against the wind will cause the wind to lose its force at the forward portion of the sail.

In the hitherto known wing profile sails no success has been achieved in obtaining an entirely favourable profiling, with the result that the above-mentioned driving force on the sail and thereby on the boat has not been as great or as efficient as desired. Thus it is an object of the invention to provide a wing profile sail which can supply the most optimal profiling possible.

A further problem with the known wing profile sails has been that they have not been entirely easy to handle, either during sailing or when hauling in and stowing away the sails.

OBJECT AND SUMMARY OF THE INVENTION

Thus it is also an object of the invention to find an improved solution to this problem. The sail should therefore preferably be capable of being rolled on a roller device.

The above-mentioned objects are achieved with a wing profile sail of the type mentioned in the introduction, which is characterized by the features which are present in the patent claims.

The wing profile sail according to the invention is based on three main elements. In order to achieve the best possible shape for the sail at the front edge, in the inner space of the sail in this area there is provided a bag or lung which can be extended in its longitudinal direction, thereby forming a body which is upwardly tapering, conical, preferably cylindrical in cross section and which forms the front section of the sail, giving it a rounded shape, which will ensure the splitting of the wind which follows the sail on the windward and leeward sides. This cylindrical body forms the basis for the sailcloths on the two sides and, when the sail and/or including the body is rotated, will ensure a change in the shape or the draft of the sail on the two sides. It has been found that an optimal adaptation of the air currents in relation to one another can thereby be achieved for the two sides. The critical feature here is the rounded shape which has been assigned to the front section of the sail.

The next main element of the sail according to the invention consists in the sailcloths on the two sides being connected at a distance from the after leech, with the result that the sail's inner space does not "fill" the entire sail surface. By this means a particularly favourable design of the sail surface is obtained, while at the same time the after leech part of the sail obtains greater flexibility and can follow the wind in a more favourable manner. In an advantageous embodiment this rearmost part of the sail surface can also be designed with a specially shaped line of curvature which ensures additional flexibility for the actual after leech.

This element of the invention gives the sail an extra favourable, aerodynamic shape, which at the same time the part of the sail where the wind is released has a desired deflective degree of freedom.

The third main element of the invention consists in the use of an internal intermediate sailcloth which has two functions, viz. to provide a one-way flap valve for the air opening in the sail, thus causing the air openings to be automatically closed on one side and kept open on the other side, while at the same time the sail surface in the rear area of the three-dimensional part of the sail, due to this intermediate sailcloth, is given an extra stiffening which has a particularly favourable effect on this part of the sail.

In connection with these main elements of the invention a number of advantageous additional designs may be employed.

BRIEF DESCRIPTION OF THE DRAWINGS

The invention will now be described in more detail by means of embodiments which are illustrated in the drawings, in which:

FIGS. 2A and 2B are a section of the mast and a sail according to the invention wherein FIG. 2A is a detail view illustrating a control mechanism.

DETAILED DESCRIPTION OF THE PREFERRED EMBODIMENTS OF THE INVENTION

Figure 1:
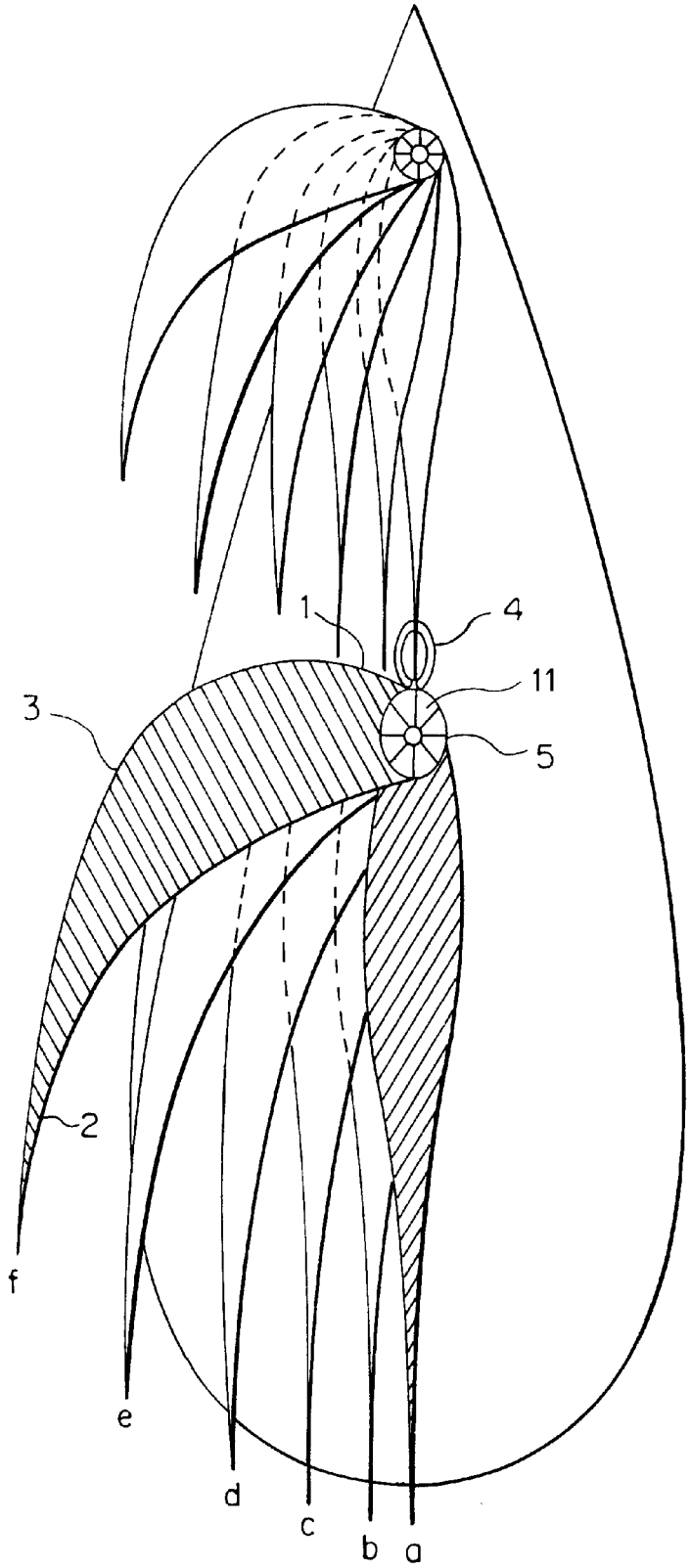
FIG. 1 is a section of wing profiles for sails on a sailing boat, in which the alterations in shape of the profile at different sheet angles are illustrated.

FIG. 1 of the drawing is a purely schematic illustration of how the aerodynamic shape of a wing profile sail according to the invention changes with different angles of incidence of the wind. The drawing illustrates a boat with a mast 4 on which there is mounted a sail and where in the boat's forward section there is mounted a corresponding foresail or jib on a not illustrated forestay. The sail profile's thickness and shape will be altered in relation to the sail's sheet angle.

As shown in the figure the sail has a rounded front edge 1, which is attached in a suitable fashion to the mast 4 or the forestay. The sail is attached to the stay or the mast and tightened up in its longitudinal direction. The rounded shape of the sail's front edge 1 has been achieved by placing in the forward area of the sail's inner space a conical, inflatable body, which is stretched and kept taut by the tightening of the sail. The sail has two separate cloths, which are designated by 2 on the windward side where they are drawn tight, while the sailcloth 3 on the leeward side is correspondingly slack. This helps to form an asymmetrical, three-dimensional profile which by itself adjusts the profile thickness in relation to the sheet angle. As illustrated in the figure, this will give the sail a narrow profile as illustrated by the letters a or b, when the vessel is closehauled to the wind, and a thicker profile, as, e.g., illustrated by e and f, when reaching and running, where the thick profile gives the wind on the sail's leeward side 3 a path round the sail which is between 0 and 50% longer and which in turn gives a great pressure difference and increased "lift" or "drag" for the sail.

FIG. 2 illustrates a section of a mast 4 which has been given different shapes in the two sectional figures. The conical, inflatable body in the sail's front edge is advantageously provided in its lower edge with a wing control wheel 5, which may be given different shapes. In the attached figures schematic views have been employed illustrating a wheel shape, but this element may also, e.g., be ball-shaped, which can be particularly favourable in some cases. The construction need not have any control wheel at all, and such a design will also be within the scope of the invention. However, the simplest control will be obtained with a control wheel 5 or possibly a ball-shaped body.

Figure 2B:
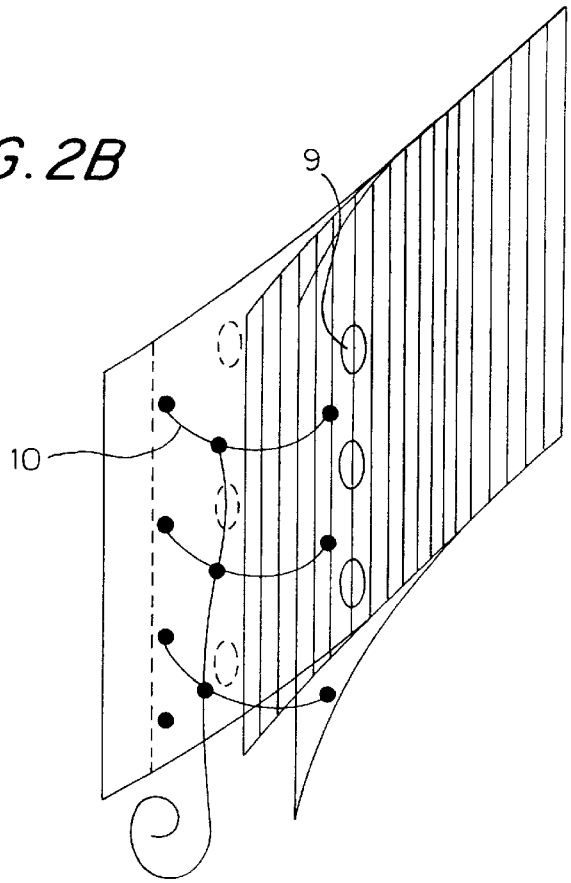

Thus FIGS. 2A and 2B illustrate the section of the mast, a wing control wheel 5, the sailcloth surfaces 2, 3 together with transverse control lines 10 across the profile's rear part in the area designated 6. The sailcloth surfaces 2, 3 are attached at the control wheel's 5 front edge and extend around the rotatable control wheel. At the profile's rear part the two sailcloth surfaces meet on each side of the sailcloth surface 7 which forms the profile's rear edge. This sailcloth surface projects some distance in between the two outer sailcloth surfaces and into the profile sail's inner space. In the space between the sailcloths 2 and 3, this sailcloth surface 7 acts as a valve flap, which swings from side to side relative to which side the wind pressure is coming from. The sailcloth in this area is designated by 13 and will thus close a number of holes or valves (not shown) in the outer sailcloths. The valve holes on the leeward sailcloth surface will thereby always be closed, since the centre sailcloth or intermediate sailcloth will cover the openings in the sailcloth towards the leeward side. At the same time an opening is formed for the holes on the windward side, where air from the profile's pressure side fills the interior of the profile. The air will fill up the entire space between the sailcloths, and the shape of the profile towards the rear edge is adjusted by means of the control line 10 between the outer sailcloths, thus assisting in forming the profile's rear part. It will also be possible to define this air space by mounting a transverse sailcloth surface 8 which is illustrated by a broken line in the figure on the right in FIG. 2A. A defined lung or air space will thereby be formed which can be used to adjust the profile correctly. Two independent air spaces or lungs are obtained in the sail. The adjustment with control lines is illustrated in the detail sketch in FIG. 2B, which also indicates the openings 9 in the sailcloth. In addition to the said spaces or lungs in the sail's inner space, as mentioned above a conical additional body is also employed which forms an air space in the sail's forward section. This space is designated by 11 and is illustrated in detail in FIG. 3. The conical space forms a separate air space in the sail and, as illustrated in the drawing, is advantageously based on a control wheel 5 in which the lower edge of the conical sailcloth is attached. The control wheel may be rotatable. The cone forms the sail profile's rounded front edge, simultaneously establishing a fixed cone which in turn helps to tighten the sailcloth on the windward side while at the same time loosening the sailcloth on the leeward side relative to the profile's sheet angle.

Figure 3A:
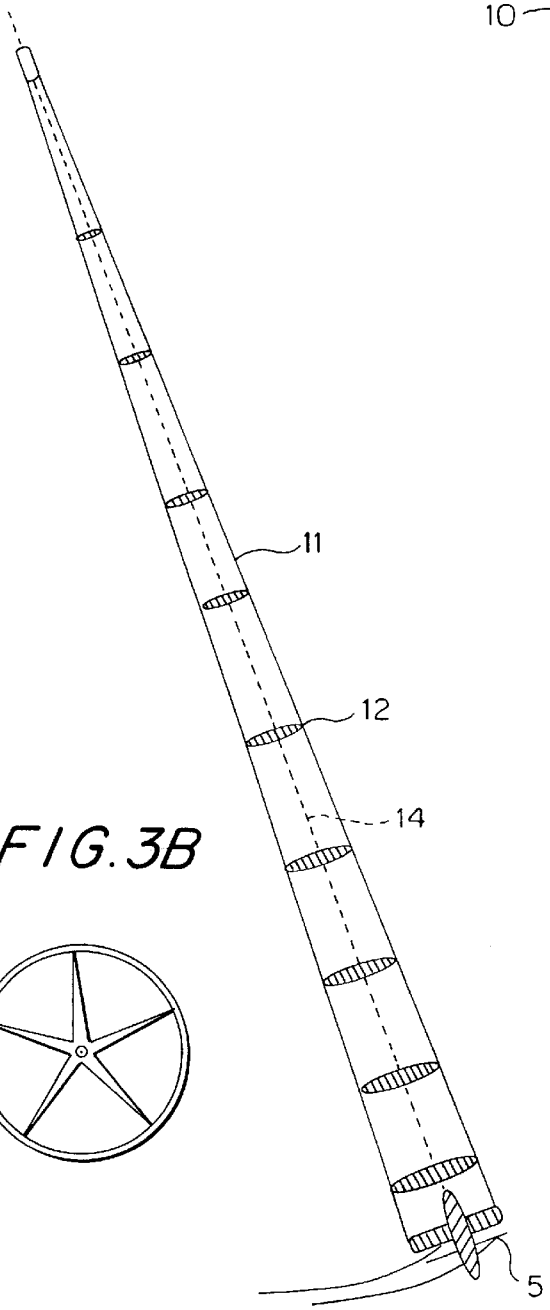
FIG. 3 is a view illustrating the conical bodies which are mounted in the front section of the sail.
Figure 3B:
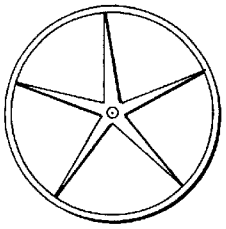

FIG. 3 illustrates a design in which a conical body 11 is arranged around the headstay or an attaching wire for the sail. At the top of the cone there is mounted a swivel (not illustrated in detail) which makes it possible for the body or the profile to rotate around the headstay 14. This is done by rotating the conical profile by means of the control wheel 5, which can be locked and adjusted in all positions. By rotating the cone independently, it is possible to fully control and form the ideal profile shapes which form the basis for the wing profile design which is employed in the invention. When the cone is fastened in the ring or the wheel edge, it forms a very secure, stable front edge with the correct shape. On sails which are mounted on stays, there are installed rings 12 which rotate with the body with rotating attachments around the stay. These have the same fundamental design as the control wheel 5 and are indicated as a detail drawing in FIG. 3. The control wheel 5 can act as a roller reefing which rolls the profile out and in by rotating the cone or the luff. The sail's cloths 2 and 3 are attached on each side around the conical profile in such a manner that they meet and are fastened to the conical profile's front edge.

Figure 4:
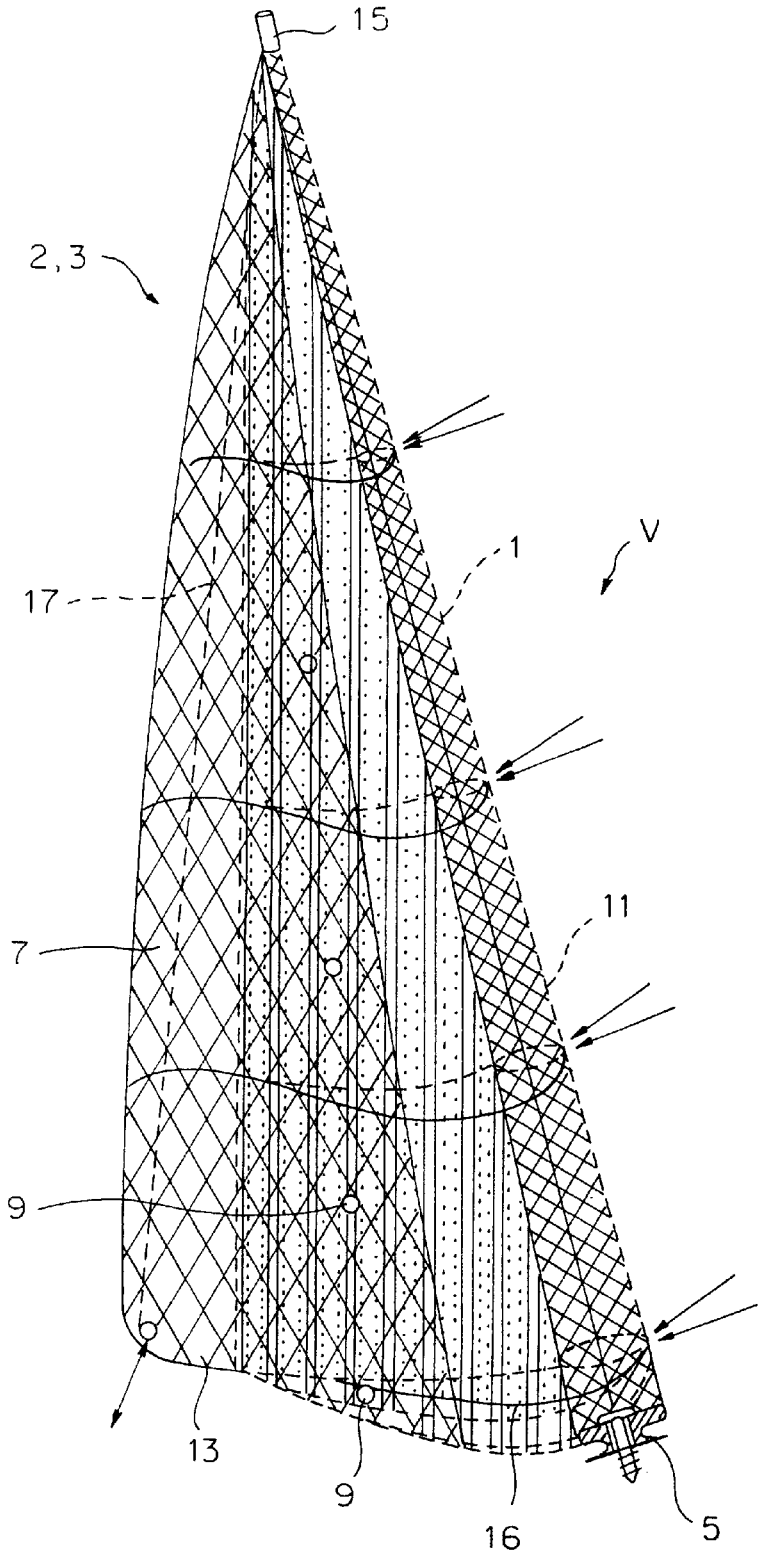
FIG. 4 is a schematic view illustrating the three-dimensional wing profile sail for mounting on a stay.

FIG. 4 illustrates a three-dimensional roller wing stay sail. The sail is shown here with wind coming in from the left side, indicated by an arrow V. This forms an asymmetrical, three-dimensional wing profile. The wing profile is composed of the following components: the wing's front edge, indicated by arrows and illustrated as a hatched cone, which extends along the whole front edge and is composed of a conical sailcloth body 11 which is attached around the control wheel 5 at the lower, thickest part and at the top 15 encloses a swivel which assists in enabling the sail to be rotated, adjusted or rolled in round the conical profile (the swivel is not illustrated in detail). The conical body 11 forms the sail's luff, creating a rounded, stable front edge in relation to how hard the sail is stretched in the longitudinal direction. By allowing air/wind to flow into the cone via openings along the profile's front part, the conical body 11 will obtain an air pressure which is in proportion to the wind velocity on the outside. The conical body 11 may also be supplied with air pressure via the valves in the sail surface and in through openings in the conical sailcloth inside the space or the lungs. This pressure will help to maintain the circular conical shape under varying wind conditions. By mounting rings inside the cone, as illustrated by the arrows, these will provide the conical body with additional stability of form. By mounting the conical body round a wire or another stay where rings are used as shown in FIG. 3 where the rings centre the cone round the stay, the luff will be further stabilised. Here the cone rotates around the stay. The conical body is enveloped by a sailcloth surface, which extends from the area at the profile's rear edge (shown as vertical parallel lines in the figure) forward and round the cone, backwards towards and back to the area at the rear edge (indicated by a dotted surface behind the horizontal, parallel lines in the figure). In this area 6 the two sailcloth surfaces 2, 3 enclose a rear sailcloth surface 7 which is indicated by a diagonal grid in the drawing. This sailcloth surface 7 has the following functions: the surface forms the profile's rear edge and rear area, extending forwards and into the space or in between the two sailcloth surfaces 2, 3 to the area against the profile's front edge. This sailcloth surface 13 is sufficiently stiffened with diagonal elastic sufficiently rigid battens, tapes and/or corresponding elastic fibres woven into the sailcloth. On roller sails the fibre direction is as indicated in the drawing with a diagonal grid pattern. This stiffening pattern together with the conical body makes it possible to roll up relatively rigid battens or fibres since they are rolled diagonally round the conical profile. The stiffening gives a highly stable rear edge to the profile. The sufficiently stiffened sailcloth surface 13 in between the sailcloths is also the flap 13 in a valve system, where the stiffened intermediate sailcloth abuts against either one or the other outer sailcloth surface 2, 3 relative to the wind's angle of attack against the profile. In the outer sailcloths 2, 3 there are circular holes or valves 9 which admit air into the space between the sailcloths 2, 3 inside the sail's lung.

On the lower edge of the profile, from the front edge and along a distance of approximately ⅔ of the chord length, a bottom bag 16 is attached between the two sailcloth surfaces and in towards the front edge profile. The bag is indicated by dotted lines. By this means the profile's adjustable pressure chamber or air lung is formed. Air is supplied to the lung through openings 9 in the sailcloth surfaces, indicated here by five circles. Both the sailcloth surfaces 2, 3 have openings, and the intermediate sailcloth 13 in between the sailcloth surfaces in the lung acts as a valve flap since it always seals the openings on the profile's leeward side by simultaneously opening on the windward side relative to the profile's active working position towards the wind. The air pressure inside the profile also acts inside the conical profile via openings in the sailcloth surface.

As already mentioned, the air pressure is controlled by means of a number of holes or valves 9. Zip fasteners may be installed at the top and bottom of the profile in order to release/ventilate the sail when it has to be rolled in or taken down.

At the rear edge of the sail there is shown a dotted vertical line 17 which indicates a perforation which reduces the stiffness of the sailcloth surface along the line. This gives a deflective rear edge which increases the effect of the profile.

Figure 5:
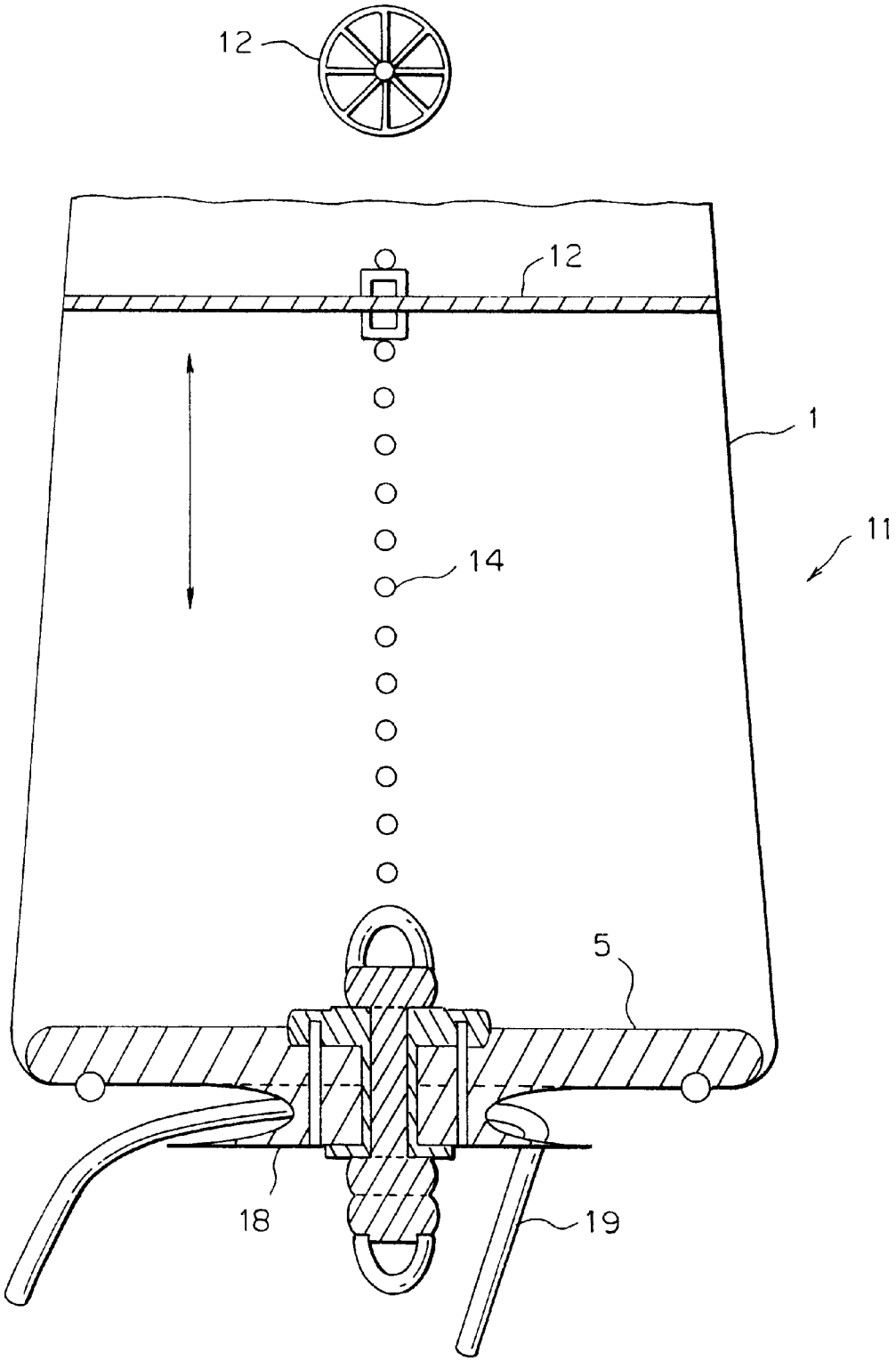
FIG. 5 is a detail view illustrating a roller device for the conical body.

FIG. 5 illustrates a section through the lower part of the conical body 11 with a roller device and retaining rings which rotate, the whole assembly being mounted around the headstay 14. It can be seen here how the cloth of the conical body 11 is attached to the control wheel which together with the clamp disk 18 with hauling rope 19 rotates freely round the stay 14, thus enabling it to both roll in the sail as well as to control and adjust the profile shape. The inserted picture shows a section through a retaining ring 12. When the sail is stretched on the stay 14, the cloth in the conical body takes over the tensile forces from the stay 14. This helps to make the conical body highly stable.

Figure 6A:
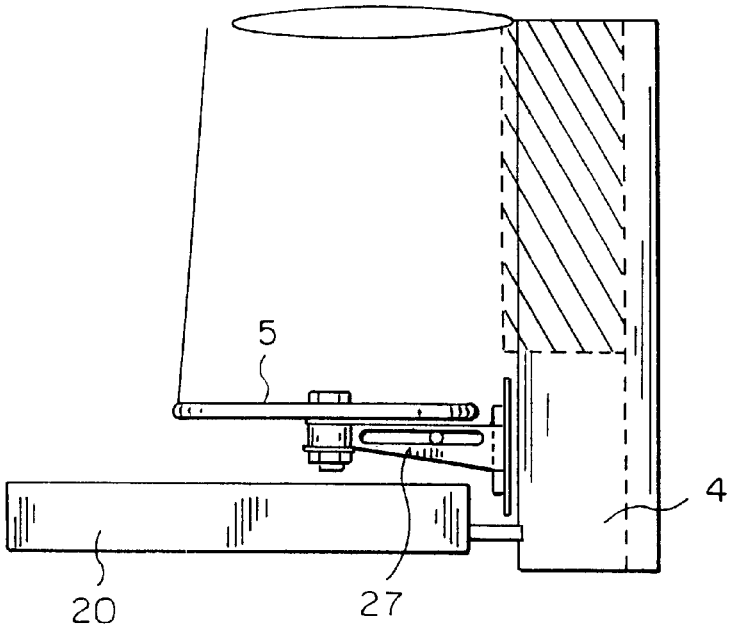
FIG. 6 is a view illustrating the mast, boom and control wheel for the conical body viewed from the side, together with a view from above illustrating the control wheel's and the sail's possibilities for movement around this mast.
Figure 6B:
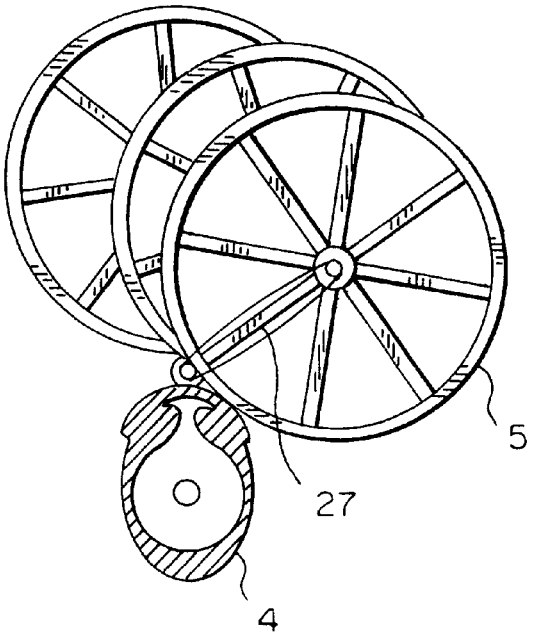

FIG. 6 illustrates the mast 4, boom 20 and conical control wheel 5 viewed from the side. The lower drawing shows the same viewed from above, in which it can be seen that the control wheel 5 can be rotated in a path round the mast's 4 rear edge by means of a link arm 27. At the same time the wheel itself 5 is rotatable about its own axis. Together this assists in integrating the mast and the sail's luff, thus achieving laminar flow conditions round mast and luff. The wheel 5 and the link arm 27 can both be locked independently of each other in fixed positions in relation to wing profile choice. An alternative will also be to attach the wheel to the boom, which can provide an advantageous pattern of movement (not shown). By using a ball instead of a wheel, in both cases the sail can be tightly sealed right down around the ball, thereby sealing the conical body and the bottom of the sail.

Figure 7:
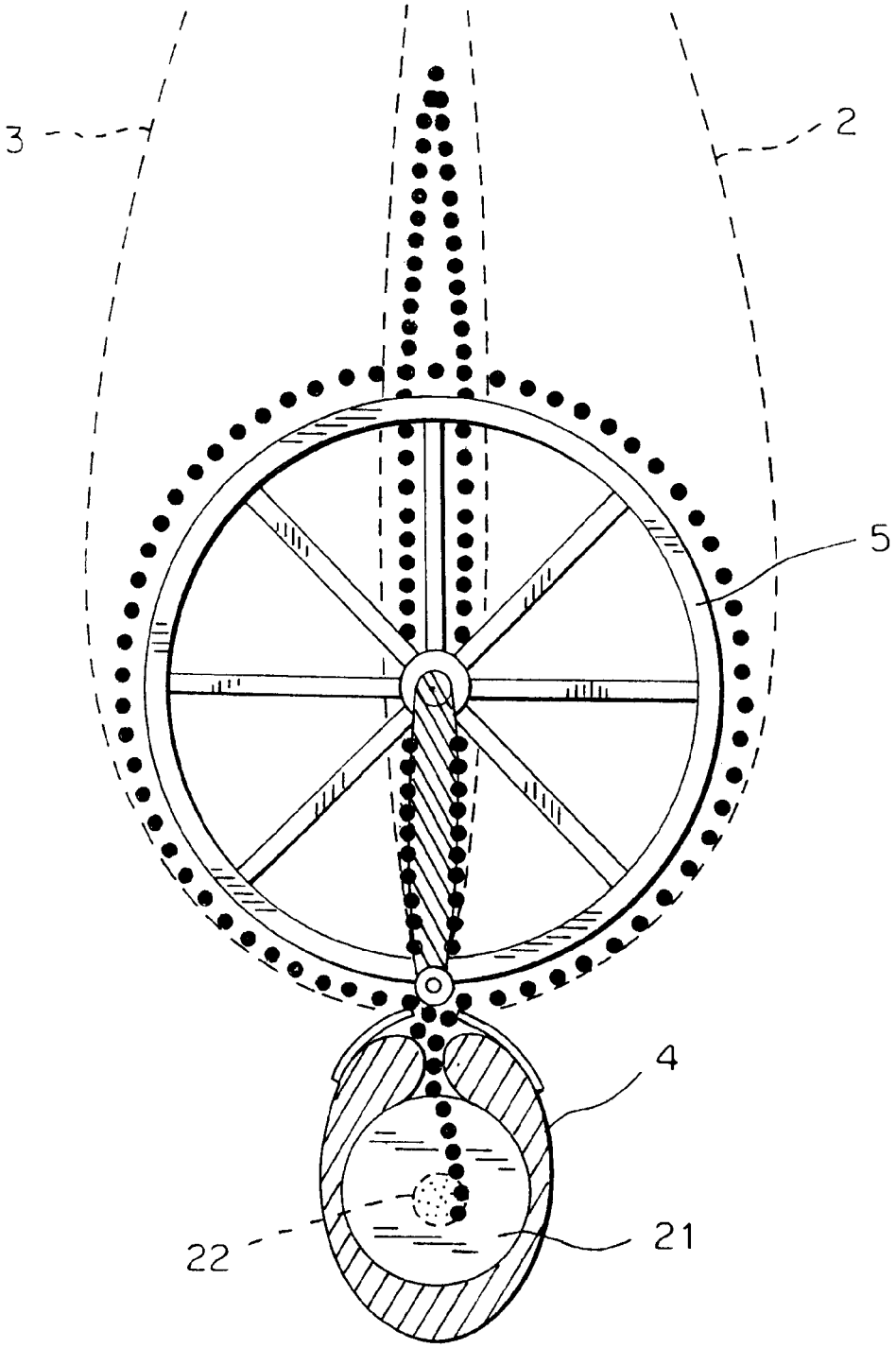
FIG. 7 is a view illustrating the sail according to the invention used in connection with a mast equipped with a roller device.

FIG. 7 illustrates a section through the control wheel 5, sailcloth surfaces 2, 3 together with the mast profile 4 with in-built roller device 21. It can be seen here how the sailcloth 2, 3 extends from a roller stay 22 inside the mast 4 out through the opening in the mast 4. The sail 2, 3 is illustrated by broken lines and lies round the front edge of the conical body's cloth which is illustrated by dotted lines and the control wheel. When the sail has to be rolled into the mast the conical profile body 11 is released from the control wheel 5, the air is released from the profile 11 by opening the sail at the top by means of pulling on a line and a zip fastener or other lock device, or via a corresponding arrangement in the sail and the bottom of the lung. This helps the sailcloth surfaces to abut against each other for subsequent rolling into the mast. This is illustrated in the central area of the figure. The actual headstay profile, which is attached to the roller stay, has an excess of rolled-in cloth, thus enabling the conical profile to freely rotate in a path round the mast's rear edge. The attachment between mast 4 and control wheel 5 is seen on the mast.

Figure 8:
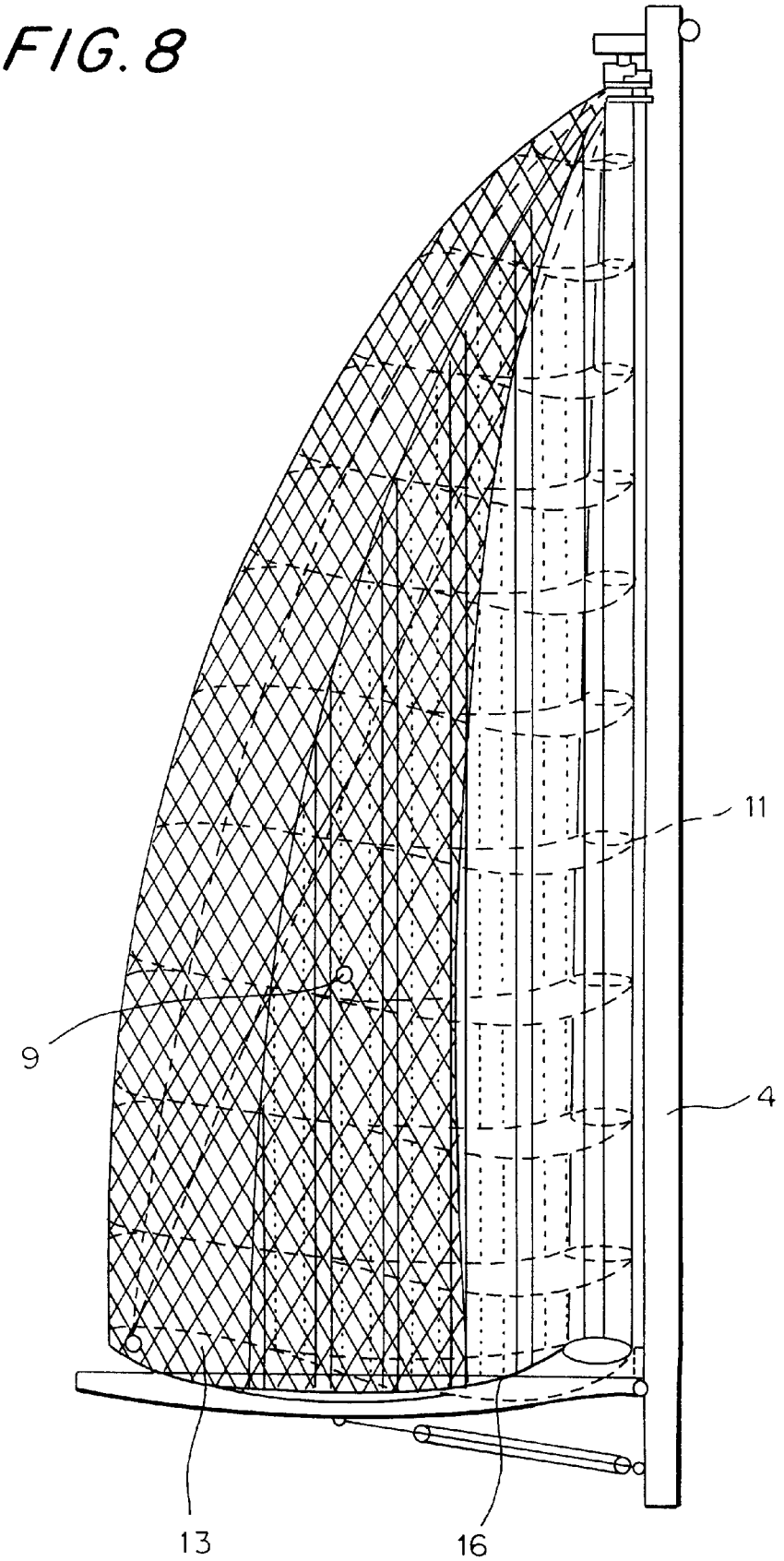
FIG. 8 is a view illustrating the sail's profile and the closing of the space in the sail.

FIG. 8 illustrates the stay and mast sail. The sewn-in pocket 16 can be seen at the bottom of the profiles illustrated by dotted lines. This pocket has a line-controlled zip fastener or other air valve device which is used to regulate the air pressure inside the lung. On the sail the air intake holes 9 (only one is shown) in the outer sailcloth surface can also be seen. The rear sailcloth surface, which also forms the intermediate sailcloth 13 which is shown on the left, is indicated by diagonal lines. This also illustrates how the said sailcloth surface abuts against the leeward outer sailcloth, closing off air from the leeward side which in this case faces the observer. The holes 9 on the windward side are then open, thus enabling air from the sail's pressure side to flow in and create an overpressure which is more than sufficient to form a stable three-dimensional profile under all wind conditions.

Figure 9A:
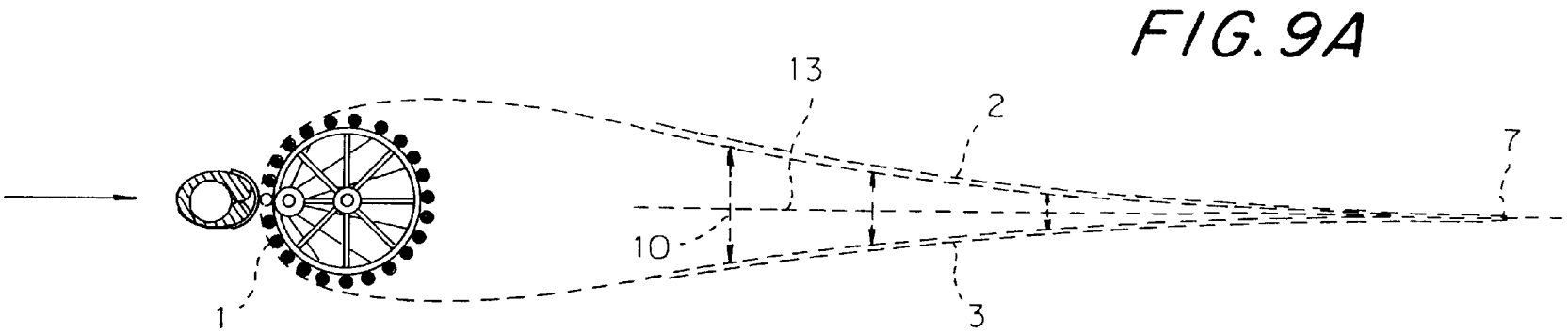
FIG. 9 illustrates two sections of the sail, with a neutral and an asymmetrical profile respectively.
Figure 9B:
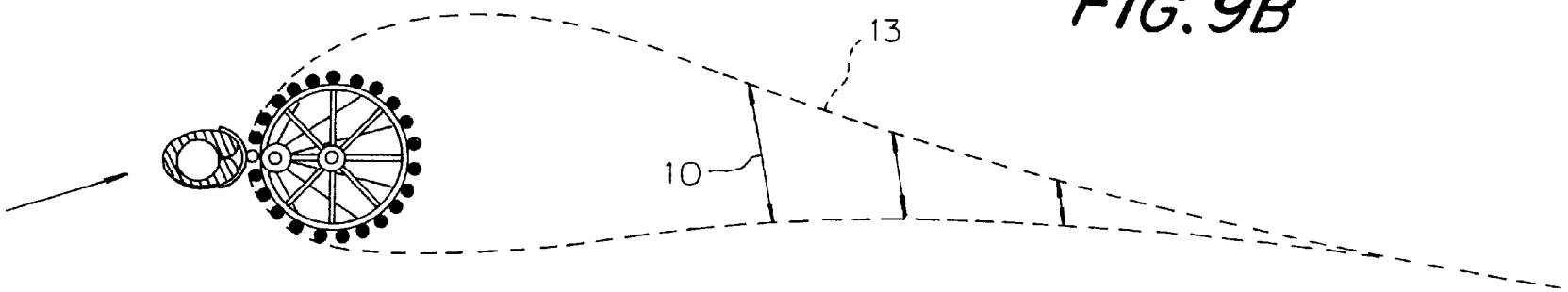

FIG. 9 illustrates a section of a neutral and an asymmetrical wing profile sail respectively. In the upper figure a dotted line 13 can be seen which extends from the sail's rear edge in between the two outer sailcloths 2, 3 and up to the profile's front edge 1. This line 13 is seen again in the bottom picture where it abuts against the leeward outer sailcloth surface, thereby sealing the valve holes in the outer sailcloth surface on the leeward side while at the same time the holes/valves are opened on the sail's windward side (the valve holes are not indicated in the figure). By this means the lung which is formed in between the sailcloths 2, 3 is filled and demarcated in the bottom or in one end of the bottom profile sailcloth 16, by the air pressure developed by the wind at any time. This air pressure is sufficiently great under all wind conditions to form a stable three-dimensional profile which can be formed into an asymmetrically or symmetrically infinitely variable wing profile.

This intermediate sailcloth 13 is sufficiently stiffened in the diagonal direction as illustrated in FIG. 8. It forms a stiffened, but rollable sailcloth surface, which at the same time helps to form the profile's leeward side as shown in FIG. 9. At the same time control lines 10 are illustrated as transverse arrows through the outer sailcloth surfaces. By tightening or slackening these lines which are mounted in sufficient numbers, the profile's rear part will be formed according to requirements (see also FIG. 2).

Figure 10:
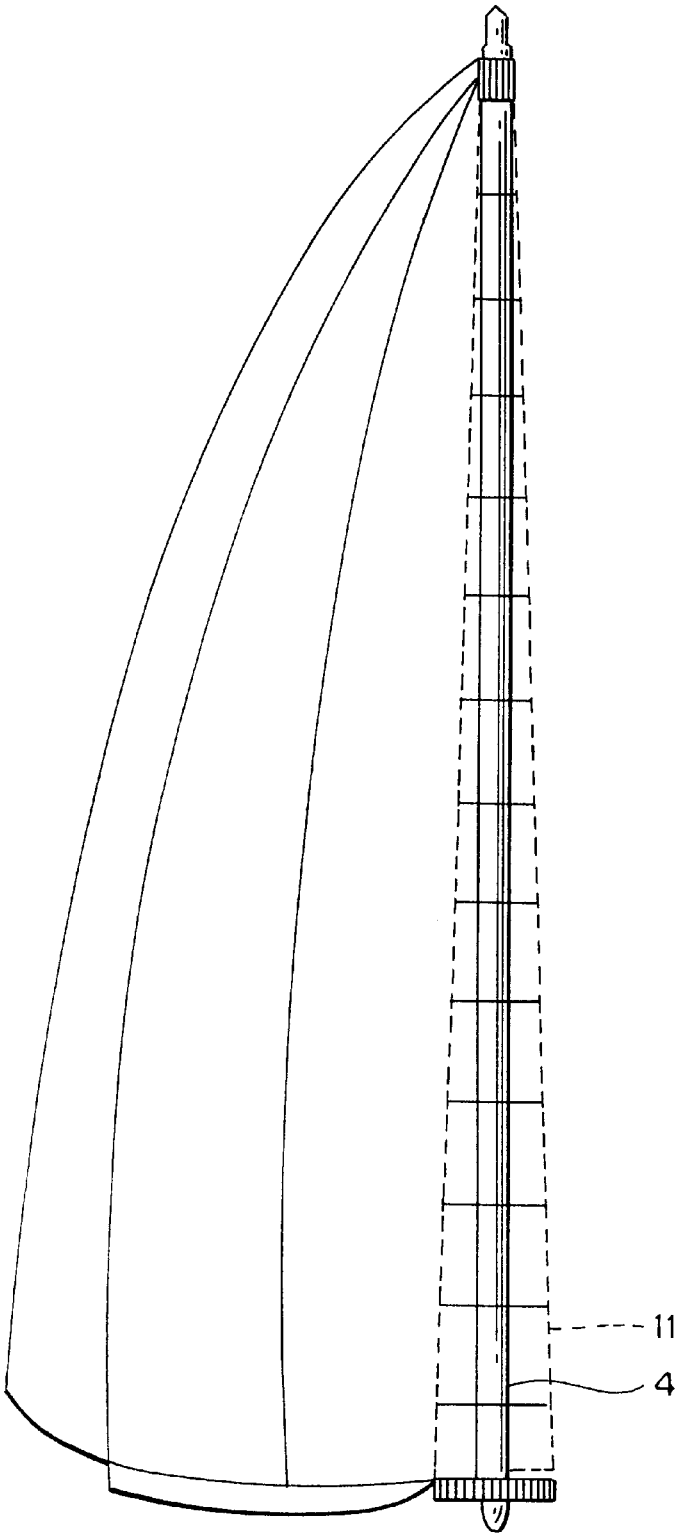
FIG. 10 illustrates a design where the sail is mounted round a mast.

FIG. 10 shows how the sail and the system can be adapted on the outside of a mast 4, where the sail is rolled in round the conical profile body 11 which envelops the mast. This is done by using swivels at the bottom and top, and here the sail rotates round a mast in the same way as described for stay sails. This is for units or vessels with self-staying or a sufficiently stiffened mast.

Figure 11A:
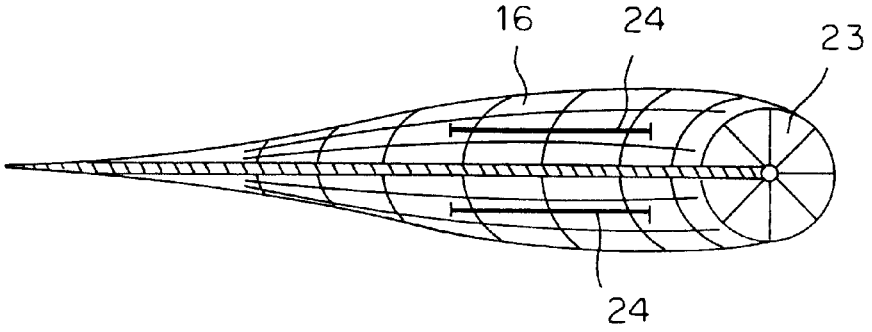
FIG. 11 illustrates a further design, with inflatable conical body, viewed from the side and from below.
Figure 11B:
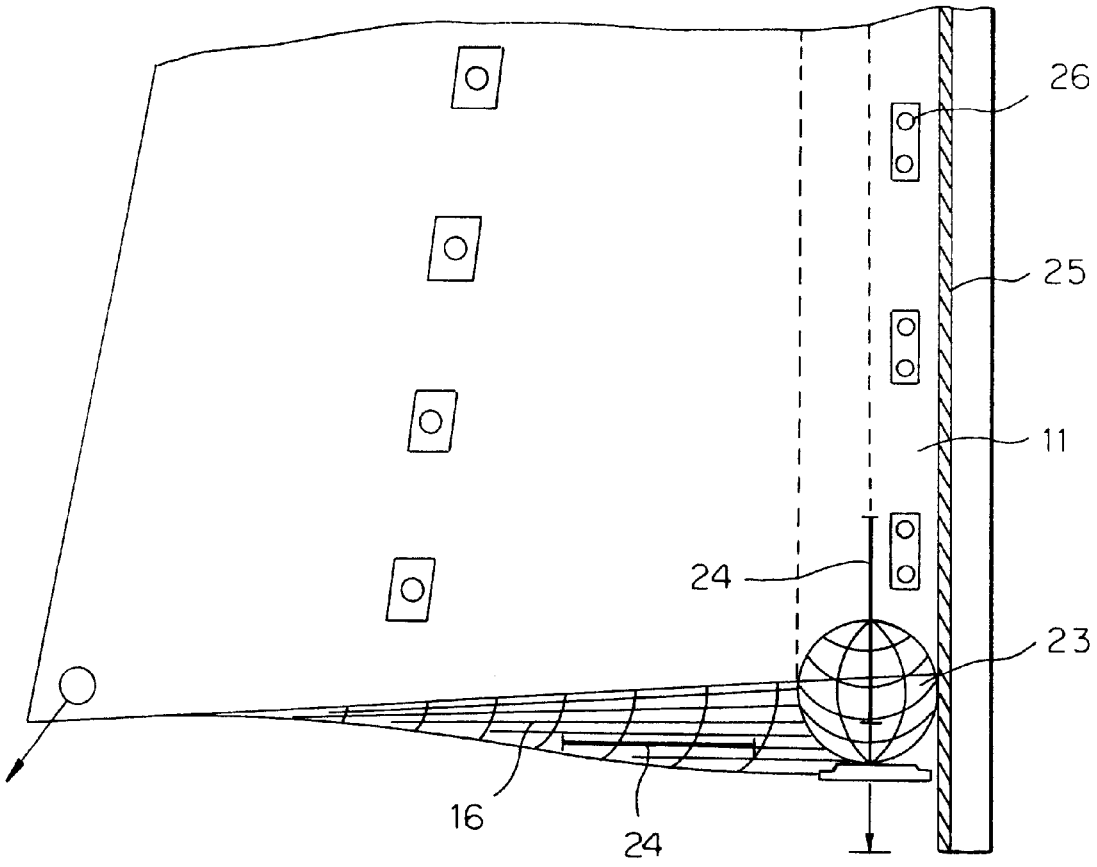

FIG. 11 schematically illustrates a further variant of the wing profile sail according to the invention, which illustrates the use of a spherical or ball-shaped body 23 as control device in the bottom edge of the conical body 11. This body 23 may be made of many different materials, both stiff and flexible. In the illustrated embodiment a flexible material is employed, with the result that the ball 23 is inflatable.

FIG. 11 illustrates a special design where the conical body is in the form of an air-filled and distended, flexible wing which is attached to the rigging in the same way as traditional sails, via hooks or mounted luff profile, which is schematically indicated by 25. A design of this kind will make the sail rollable on traditional roller systems. In this connection the conical body can be designed entirely without any control device at the bottom, but in this case it must be possible to draw it together in order to make the body 11 airtight at the bottom. Thus no problems will be encountered during rolling up, since the lacing up only has to be opened or other means found for rolling it up. A favourable design, however, is to use the inflatable ball or sphere 23 which can either be rolled up together with the sail after the air has been released or the sphere 23 can be taken out through a zip opening 24. This zip opening 24 can also be opened or closed to control air flow in the interior of the sail, thereby supplementing the openings 26 illustrated in the drawing. In a similar manner it may be advantageous to also provide zip-equipped openings 24 in the sail's bottom section, e.g. the distended sailcloth 16, as illustrated in FIG. 11, and best represented in the view from the bottom side. These zip openings 24 will then provide ventilation and possibilities for control of the air pressure in the sail in a simple manner. This applies particularly to the zip fasteners in the bottom profile sailcloth 16.

The figures illustrate the principles of the invention and provide examples of possibilities for modification. As mentioned ball or sphere elements may be employed instead of wheels and it is also entirely possible to omit such control devices, which may be favourable in some designs and when rolling into the mast. Both with the wheel and the sphere designs there are alternative mounting possibilities, either on the mast, on the boom, on a stay or on the deck. In this connection a person skilled in the art will be capable of designing the constructional features.

Another modification which is not more closely described will be to replace the batten stiffening, where tapes or battens are employed with corresponding fibre stiffening systems integrated in the sailcloth. Many modifications are thereby possible within the scope of the invention.

A wing profile sail according to the invention has been tested by means of comparative sailing with a similar boat with conventional sails. It has been shown that the boat with sails according to the invention sailed faster and could go substantially closer to the wind, with the result that the boat's sailing characteristics were significantly improved.

What is claimed is:

1. A wing profile sail, having a sailcloth (2, 3) which encloses an inner space shaped as an airfoil, said sailcloth (2, 3) including openings (9) with a one-way closing mechanism to permit said inner space to be filled with air;

said wing profile sail further comprising a body (11) inflatable by air, located at a luff of the sail entirely within said inner space, wherein said body tapers upwards with a circular cross section and is conical when extended in height and inflated with air to engage against a front edge (1) of the sailcloth (2, 3);

wherein two sides of the sailcloth (2, 3) respectively extend back from said front edge (1) and are engaged together at a rear edge of the sailcloth (2, 3);

an after part (7) engaged between said two sides at the rear edge extending into the inner space as an intermediate sailcloth (13) to serve as the one-way closing mechanism when covering said openings (9); and wherein said two sides of said sailcloth (2, 3) are engaged together by a bottom area (16) to complete closure of said inner space.

2. A wing profile sail according to claim 1, wherein the intermediate sailcloth (13) forms an extension of the after part (7).

3. A wing profile sail according to claim 1, wherein the body (11) is mounted on a control wheel (5) and is equipped with internal stiffening rings (12).

4. A wing profile sail according to claim 3, wherein the sail is rollable around the body (11) on an internal stay (14), the control body (5) forming a roller part.

5. A wing profile sail according to claim 1, wherein the body (11) is mounted on an inflatable spherical control device (23).

6. A wing profile sail according to claim 1, wherein the wheel (5) is mounted on a mast (4).

7. A wing profile sail according to claim 1, wherein the control wheel (5) is rotatable and movable by means of a hauling line arrangement (19).

8. A wing profile sail according to claim 1, wherein the inner space is closed off at a bottom by a distendable sailcloth (16), which permits the sides of the sailcloth (2, 3) to move parallel to each other at the bottom of the sail.

9. A wing profile sail according to claim 1, wherein the inner space can be divided into several chambers by means of partition walls (8).

10. A wing profile sail according to claim 1, wherein the body (11) is attached to a deck by means of standard attachment device.

11. A wing profile sail according to claim 1, wherein a stay (14) passed through the body (11).

12. A wing profile sail according to claim 1, wherein the body (11) is placed around a mast (4).

13. A wing profile sail according to claim 1, wherein the sailcloth (2, 3), at least in the after part (7), and the intermediate sailcloth (13) are reinforced with diagonal stiffeners.

14. A wing profile sail according to claim 1, wherein the after part (7) is equipped with a weakening part (12) which is perforated to improve the flexibility of the after part (7).

15. A wing profile sail according to claim 1, wherein the inner space is equipped with adjustable control lines (10) between the sides of the sailcloth (2, 3) to influence a profile of the sail cloth.

16. A wing profile sail according to claim 1, wherein the body (11) is in the form of a flexible wing which can be filled with air and which is attached to a rigging by hooks, the body being designed without a control device or with an inflatable spherical body (23).

17. A wing profile sail according to claim 1, wherein an inflow and outflow of air into the inner space can be controlled by zip fastener openings (24).

18. A wing profile sail having a sailcloth (2, 3) which encloses an inner space shaped as an airfoil, said sailcloth (2, 3) including openings (9) with a one-way closing mechanism to permit said inner space to be filled with air;

said wing profile sail further comprising a body (11) inflatable by air, located at a luff of the sail entirely within said inner space, wherein said body tapers upward with a circular cross section and is conical when extended in height and inflated with air to engage against a front edge (1) of the sailcloth (2, 3);

wherein two sides of the sailcloth (2, 3) respectively extend back from said front edge (1) and are engaged together at a rear edge of the sailcloth (2, 3);

an after part (7) engaged between said two sides at the rear edge extending into the inner space as an intermediate sailcloth (13) which serves as the one-way closing mechanism when covering said openings (9); and wherein said two sides of said sailcloth (2, 3) are engaged together by a bottom area (16) to complete closure of said inner space wherein the inner space is equipped with adjustable control lines (10) between the sides of the sailcloth (2, 3) to influence a profile of the sailcloth.

19. A wing profile sail according to claim 18, wherein the air fillable body (11) is mounted on a control wheel (5) and is preferably equipped with internal stiffening rings.

20. A wing profile sail according to claim 18, wherein the wheel (5) is mounted on the mast (4).

* * * * *